US010490172B2

(12) United States Patent
Notsu

(10) Patent No.: US 10,490,172 B2
(45) Date of Patent: Nov. 26, 2019

(54) MUSICAL SOUND PLAYBACK APPARATUS, ELECTRONIC MUSICAL INSTRUMENT, MUSICAL SOUND PLAYBACK METHOD AND STORAGE MEDIUM

(71) Applicant: CASIO COMPUTER CO., LTD., Shibuya-ku, Tokyo (JP)

(72) Inventor: Tomomi Notsu, Kodaira (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 106 days.

(21) Appl. No.: 15/726,141

(22) Filed: Oct. 5, 2017

(65) Prior Publication Data

US 2018/0102117 A1 Apr. 12, 2018

(30) Foreign Application Priority Data

Oct. 7, 2016 (JP) ..... 2016-198673

(51) Int. Cl.

| | |
|---|---|
| ***G10H 7/00*** | (2006.01) |
| ***G10H 1/00*** | (2006.01) |
| ***G10H 1/46*** | (2006.01) |
| ***G10H 1/02*** | (2006.01) |

(52) U.S. Cl.

CPC ..... *G10H 1/0008* (2013.01); *G10H 1/02* (2013.01); *G10H 1/46* (2013.01); *G10H 7/008* (2013.01); *G10H 2220/221* (2013.01); *G10H 2240/005* (2013.01)

(58) Field of Classification Search

CPC ..... G10H 1/0008; G10H 1/02; G10H 1/46; G10H 7/008; G10H 2240/005; G10H 2220/221

USPC ..... 84/604

See application file for complete search history.

(56) References Cited

U.S. PATENT DOCUMENTS 4,999,773 A * 3/1991 Clynes ..... G10H 1/02 84/622
5,308,917 A * 5/1994 Kitamura ..... G10H 1/18 84/607
5,793,739 A * 8/1998 Tanaka ..... G10H 1/0041 369/124.14

(Continued)

FOREIGN PATENT DOCUMENTS

JP 2002169547 A 6/2002
JP 2007132961 A 5/2007

*Primary Examiner* — Jeffrey Donels
(74) *Attorney, Agent, or Firm* — Holtz, Holtz & Volek PC

(57) ABSTRACT

A musical sound playback method that is performed by a processor using data in a memory, including generating a plurality of interpolated data where input data for a segment corresponding to musical sounds has been interpolated, based on values in the input data which are related to both the segment corresponding to the musical sounds and a change amount of the musical sounds, generating a plurality of instruction data for providing instructions regarding musical sound states to be achieved at a plurality of timings in the segment, based on the plurality of interpolated data, and sequentially transmitting the plurality of instruction data to a sound source circuit so as to cause the sound source circuit to generate the musical sounds while sequentially changing the musical sounds to be in the musical sound states instructed by the instruction data, when a musical sound playback for the segment is performed.

16 Claims, 10 Drawing Sheets

(56) References Cited

U.S. PATENT DOCUMENTS

| | | | | |
|---|---|---|---|---|
| 5,827,987 | A * | 10/1998 | Kosugi | G10H 1/125 84/604 |
| 6,169,241 | B1 * | 1/2001 | Shimizu | G10H 7/04 84/604 |
| 6,798,427 | B1 * | 9/2004 | Suzuki | G10H 1/0008 84/604 |
| 2017/0004811 | A1 * | 1/2017 | Yamada | G10H 1/043 |

* cited by examiner

| |
|---|
| step:t1 |
| command:VOLUME LEVEL |
| value:10 |
| step:t2 |
| command:VOLUME LEVEL |
| value:20 |
| step:t3 |
| command:VOLUME LEVEL |
| value:30 |
| step:t4 |
| command:VOLUME LEVEL |
| value:40 |
| step:t5 |
| command:VOLUME LEVEL |
| value:50 |

FIVE COMMAND SETS

MUSICAL SOUND PLAYBACK APPARATUS, ELECTRONIC MUSICAL INSTRUMENT, MUSICAL SOUND PLAYBACK METHOD AND STORAGE MEDIUM

CROSS-REFERENCE TO RELATED APPLICATION

This application is based upon and claims the benefit of priority from the prior Japanese Patent Application N 2016-198673, filed Oct. 7, 2016, the entire contents of which are incorporated herein by reference.

BACKGROUND OF THE INVENTION

1. Field of the Invention

The present invention relates to a musical sound playback apparatus which replays musical sounds based on input data, an electronic musical instrument, a musical sound playback method and a storage medium.

2. Description of the Related Art

A musical performance apparatus (musical sound playback apparatus) called a sequencer has been known. This apparatus stores, in a memory, musical performance data representing the pitch and sound emission timing of each note composing a musical piece for each of a plurality of tracks associated with musical performance parts (musical instrument parts), and sequentially reads out the musical performance data for each track stored in the memory in synchronization with the tempo of the musical piece for playback (musical performance). For example, in Japanese Patent Application Laid-Open (Kokai) Publication No. 2002-169547, this type of apparatus has been disclosed, in which sequence data where a drum timbre and a non-drum timbre have been mixed in one track can be replayed.

In conventional musical performance apparatuses, the pitches, volume, and the like of sounds are controlled in accordance with command sets constituting musical performance data. Here, all sequential changes are made per command set. In particular, in a case where the volume level of musical sounds for a musical performance is changed from "0" to "50", the value of the volume level is controlled step by step by using five command sets, whereby the sequential changes are achieved, as shown in an example in FIG. 10. Note that each command set is constituted by "step" representing an event time indicating the execution timing of a command, "command" representing a control detail (event), and "value" representing a set value.

SUMMARY OF THE INVENTION

In accordance with one aspect of the present invention, there is provided a musical sound playback method that is performed by a processor using data in a memory, comprising: generating a plurality of interpolated data where input data for a segment corresponding to musical sounds has been interpolated, based on values in the input data which are related to both the segment corresponding to the musical sounds and a change amount of the musical sounds to be replayed for the segment; generating a plurality of instruction data for providing instructions regarding musical sound states to be achieved at a plurality of timings in the segment, based on the plurality of interpolated data; and sequentially transmitting the plurality of generated instruction data to a sound source circuit so as to cause the sound source circuit to generate the musical sounds while sequentially changing the musical sounds to be in the musical sound states instructed by the instruction data, when a musical sound playback for the segment is performed.

In accordance with another aspect of the present invention, there is provided a musical sound playback apparatus comprising: a sound source circuit which generates musical sounds while sequentially changing the musical sounds to be in instructed states in response to reception of instruction data for providing instructions regarding musical sound states to be achieved; and a processor which, by using data in a memory, (i) generates a plurality of interpolated data where input data for a segment corresponding to the musical sounds has been interpolated, based on values in the input data which are related to both the segment corresponding to the musical sounds and a change amount of the musical sounds to be replayed for the segment, (ii) generates a plurality of instruction data for providing instructions regarding musical sound states to be achieved at a plurality of timings in the segment, based on the plurality of interpolated data, and (iii) sequentially transmits the plurality of generated instruction data to the sound source circuit when a musical sound playback for the segment is performed.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

Embodiments of the present invention will hereinafter be described with reference to the drawings.

A. Structure

Figure 1:
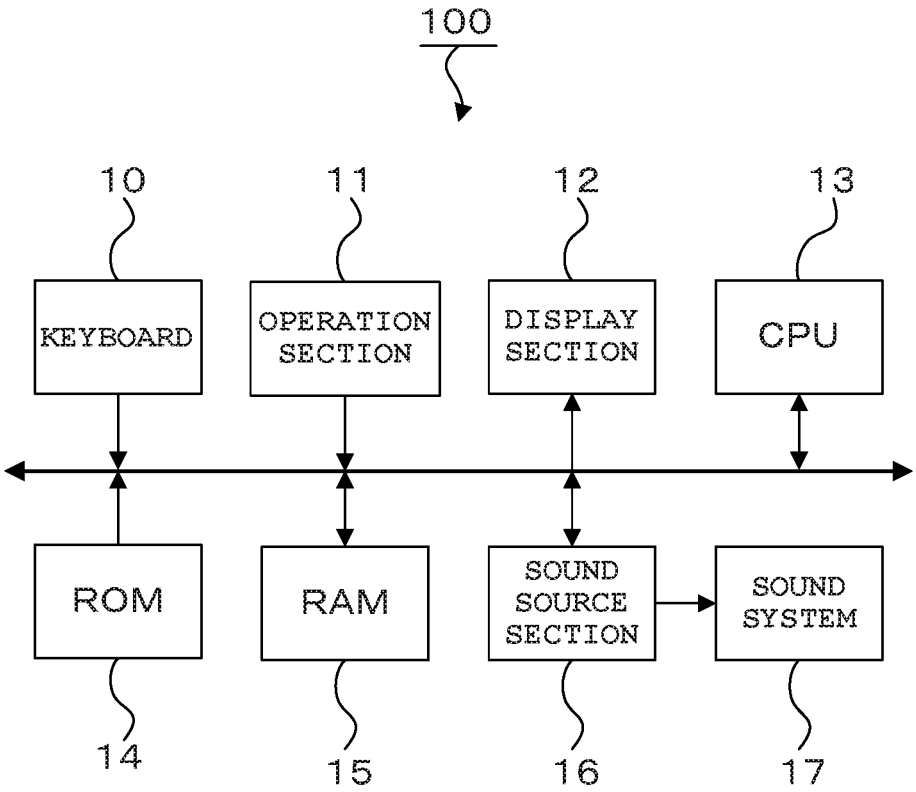
FIG. 1 is a block diagram showing an electric structure of an electronic musical instrument 100 according to a first embodiment of the present invention.

FIG. 1 is a block diagram showing the entire structure of an electronic musical instrument 100 according to a first embodiment of the present invention. A keyboard 10 in FIG. 1 generates musical performance input information including a key-ON/key-OFF signal, a key number, a velocity, and the like in response to a musical performance input operation (key press/release operation). The musical performance input information generated by the keyboard 10 is converted by a CPU 13 into a note-ON/note-OFF event in MIDI format and then supplied to a sound source section 16.

The operation section 11 is constituted by a power supply switch for turning an apparatus power supply ON/OFF, a musical piece selection switch for selecting a musical piece for a musical performance, a playback start switch for providing an instruction to start a playback (musical performance), and various operation switches such as an enlivenment start switch for providing an instruction to start enlivenment. This operation section 11 generates switch events of types corresponding to switch operations, and these various switch events generated by the operation section 11 are loaded into the CPU 13.

A display section 12 in FIG. 1 is constituted by a color liquid-crystal display panel, a display driver, and the like, and displays on its screen the setting status, operation status, and the like of each section of the musical instrument in accordance with a display control signal supplied from the CPU 13. The CPU 13 sets the operation status of each section of the apparatus based on various switch events supplied from the operation section 11. Also, the CPU 13 instructs the sound source section (sound source circuit) 16 to generate musical sound data W.

Moreover, the CPU 13 instructs the sound source section 16 to start a musical performance in response to an operation on the playback start switch. Furthermore, in response to an operation on the enlivenment start switch, the CPU 13 instructs the sound source section 16 to arrange and enliven musical performance sounds being replayed for a musical performance in accordance with enlivenment data (described later) These characteristic processing operations of the CPU 13 according to the gist of the present invention, that is, operations in playback start operation processing, enlivenment start operation processing, tick event processing, track tick processing, enlivenment tick processing, command processing, and tick processing will, be described later in detail.

Figure 2A:
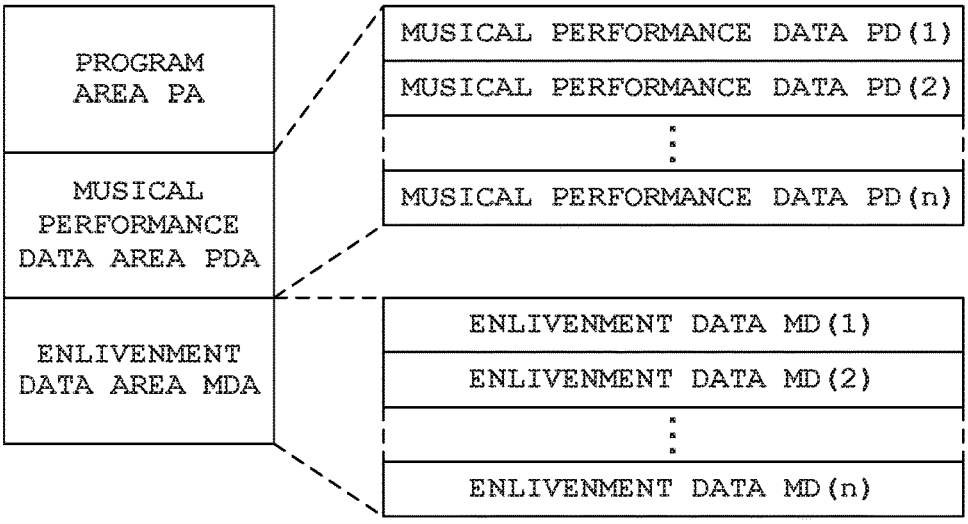
FIG. 2A is a memory map showing a data structure in a ROM (Read Only Memory) 14.

A ROM (Read Only Memory) 14 in FIG. 1 includes a program area PA, a musical performance data area PDA, and a enlivenment data area MDA, as shown in FIG. 2A. In the program area PA of the ROM 14, various control programs to be loaded into the CPU 13 are stored. The various control programs herein include programs for the playback start operation processing, the enlivenment start operation processing, the tick event processing, the track tick processing, the enlivenment tick processing, the command processing, and the tick processing described later.

In the musical performance data area PDA of the ROM 14, musical performance data PD (1) to PD (n) of a plurality of musical pieces are stored. From this musical performance data area PDA, musical performance data PD (N) selected from among the musical performance data PD (1) to PD (n) by an operation on the musical piece selection switch is read out, and then stored in a playback data area SDA (refer to FIG. 2B) of a RAM (Random Access Memory) 15 under control of the CPU 13.

In the enlivenment data area MDA of the ROM 14, a plurality of enlivenment data MD (1) to MD (N) are stored. From this enlivenment data area MDA, enlivenment data MD (N) selected from among the enlivenment data MD (1) to MD (N) by an operation on the enlivenment selection switch is read out, and then stored in the playback data area SDA (refer to FIG. 2B) of the RAM 15 under control of the CPU 13.

Figure 2B:
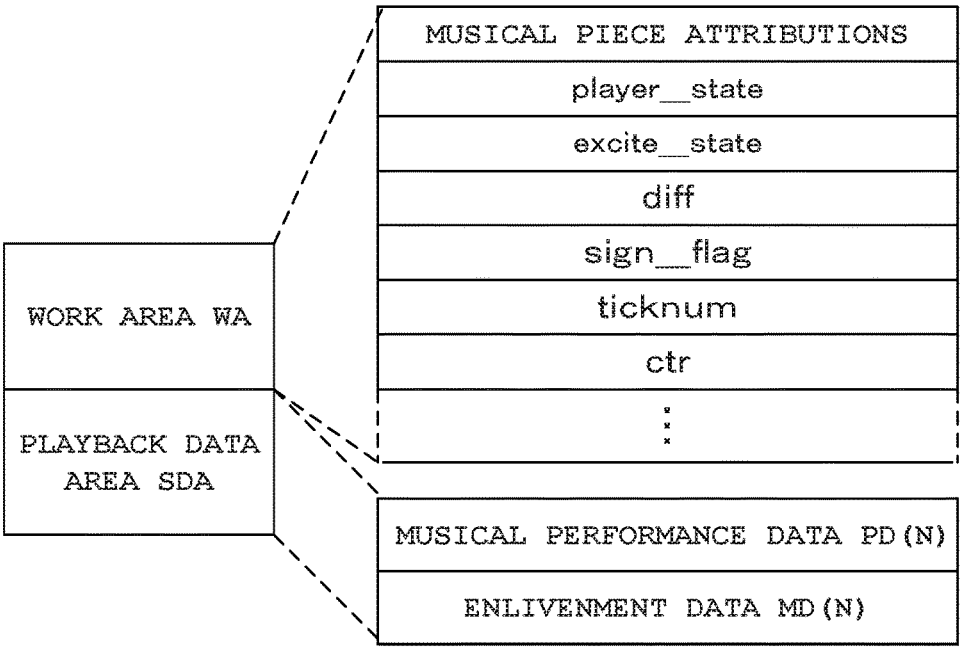
FIG. 2B is a memory map showing a data structure in a RAM (Random Access Memory) 15.

The RAM 15 includes a work area WA and the playback data area SDA, as shown in FIG. 2B. In the playback data area SDA of the RAM 15, the musical performance data PD (N) of a musical piece selected by an operation on the musical piece selection switch and enlivenment data MD (N) associated with this musical performance data PD (N) are stored after being read out from the ROM 14 under control of the CPU 13.

The musical performance data PD (N) is constituted by a system track and a plurality of musical performance tracks. In the system track, musical piece attributions such as the time base (resolution), title, tempo (BPM), and meter of the musical piece are stored. In each of the plurality of musical performance tracks which correspond to the musical performance parts (musical instrument parts) of the musical piece, musical performance data PD is stored which indicates the pitch and sound emission timing of each note forming a corresponding musical performance part and by which a control target such as a pitch or a sound volume is changed.

Figure 3A:
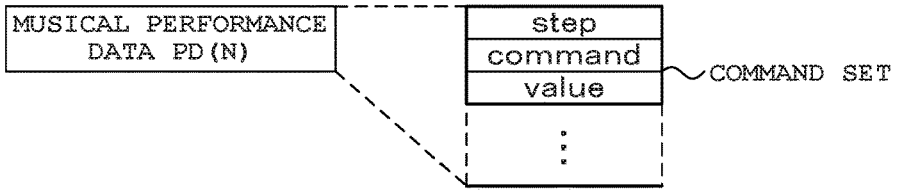
FIG. 3A is a diagram showing the structure of musical performance data PD (N)

The musical performance data PD (N) is formed by command sets, each of which includes three pieces of information ("step", "command", and "value"), being addressed in time-series corresponding to the musical progress, as shown in FIG. 3A. In each command set, "step" represents an event time indicating the execution timing of "command" by using an elapsed time from the head of the musical piece, "command" represents a control detail such as a note-ON/note-OFF event, a pitch bend (pitch control), or a control change (sound volume control) and "value" represents a set value.

Figure 3B:
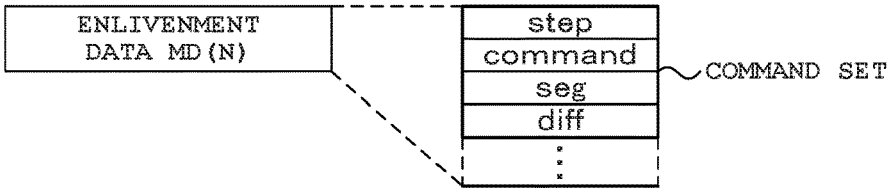
FIG. 3B is a diagram showing the structure of enlivenment data MD (N)

The enlivenment data MD (N) is constituted by a plurality of musical performance tracks corresponding to the musical performance parts (musical instrument parts) of the above-described musical performance data PD (N). In each of these musical performance tracks, enlivenment data MD is stored which arranges the musical performance data PD (N) so as to enliven the melody of a corresponding musical performance part. Also, the enlivenment data MD (N) is formed by command sets, each of which includes "step", "command", "seg", and "diff", being addressed in time-series corresponding to the musical progress, as shown in FIG. 3B.

In each command set, "step" represents an event time indicating the execution timing of "command" by using an elapsed time from the head of the musical piece, "command" represents a control detail such as a note-ON/note-OFF event, a pitch bend (pitch control), or a control change (sound volume control), "seg" represents a segment where "command" is executed, and "diff" represents a difference value (or an attainment value).

Figure 3C:
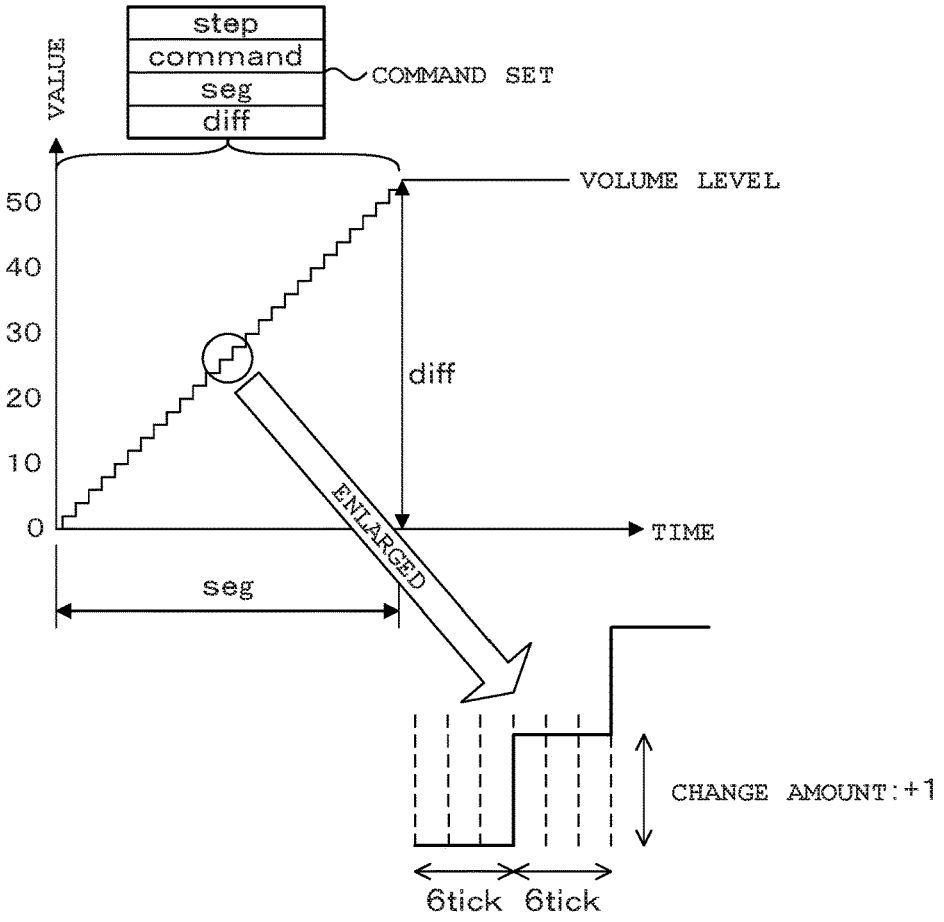
FIG. 3C is a diagram describing details of a command set in the enlivenment data MD (N)
Figure 10:
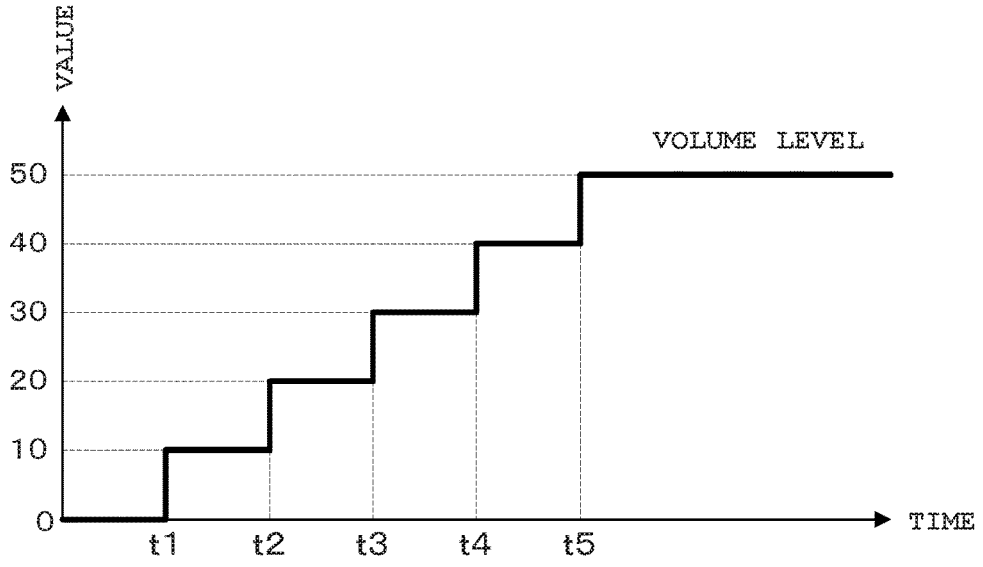
FIG. 10 is a diagram for describing the problem of the conventional technique.

That is, in the conventional musical performance data, when the volume level of musical sounds is to be changed from "0" to "50" by use of command sets each including "step (event time)" "command (control target)", and "value (set value)", the value of the volume level is set in a stepwise manner by use of five command sets, whereby the sequential changes are achieved, as shown in the example in FIG. 10. However, in the musical performance data of the present invention, these sequential changes are defined based on "seg" (segment) and "diff" (difference or attainment value) in one command set, as shown in an example in FIG. 3C. By this data structure, the volume of musical performance data can be reduced.

Also, in the present invention, in order to achieve the sequential changes defined by "seg" (segment) and "diff" (difference or attainment value) included in one command set, the value of a control target is controlled per "tick". This "tick" is a minimum unit time calculated by 60/BPM (tempo)/time base (resolution). In the case of the example shown in FIG. 3C, control is performed such that the value of a control target is increased by 1 every 6 ticks so as to achieve sequential changes. As a result, the control target is sequentially and finely arranged. This control per "tick" is described later.

In the work area WA of the RAM 15, various pieces of register/flag data for use in processing by the CPU 13 are temporarily stored. FIG. 2B shows main register/flag data according to the gist of the present invention. "Musical piece attribution" in the drawing includes a time base (resolution), a title, a tempo (BPM), a meter, and the like. The flag "player_state" indicates "PLAY" when a musical performed is started in response to an operation on the playback start switch, and indicates "STOP" when the musical performance is stopped.

The flag "excite_state" indicates "PLAY" when enlivenment is started in response to an operation on the enlivenment start switch, and indicates "STOP" when the enlivenment is stopped. In the register "diff", a difference value "diff" included in a command set of a processing target is temporarily stored. The flag "sign_flag" indicates "0" when a difference value "diff" acquired from a command set is a positive value, and indicates "1" when it is a negative value. In the register "ticknum", the number of ticks required per difference value representing "1" is temporarily stored. The counter "ctr" counts the number of ticks.

Referring back to FIG. 1, the structure of the electronic musical instrument 100 is further described. The sound source section 16 in FIG. 1, which includes a plurality of sound emission channels formed based on a known waveform memory reading method, generates musical sound data in response to a note-ON/OFF event based on musical performance input information.

Also, when a musical performance is started in response to an operation on the playback start switch, the sound source section 16 replays musical performance data PD (N) read out from the playback data area SPA of the RAM 15 by the CPU 13, and generates musical performance sound data for each musical performance track. When enlivenment is started in response to an operation on the enlivenment start switch, the sound source section 16 replays enlivenment data MD (N) read out from the playback data area SDA of the RAM 15 by the CPU 13, and arranges musical performance sound data that is being executed for a musical performance.

A sound system 17 in FIG. 1 converts musical sound data/musical performance sound data outputted from the sound source section 16 into musical sound signals/musical performance sound signals in an analog format, performs filtering such as removing unnecessary noise from the musical sound signals/musical performance sound signals, and then amplifies the resultant signals to emit sounds from a loudspeaker (not shown).

B. Operations

Next, as operations of the above-structured electronic musical instrument 100, each operation by the CPU 13 in the playback start operation processing, the enlivenment start operation processing, the tick event processing, the track tick processing, the enlivenment tick processing, the command processing, and the tick processing are described with reference to FIG. 4 to FIG. 7. Note that, in the descriptions of the operations described below, these operations are performed by the CPU 13 unless otherwise noted.

(1) Operations in Playback Start Operation Processing

Figure 4A:
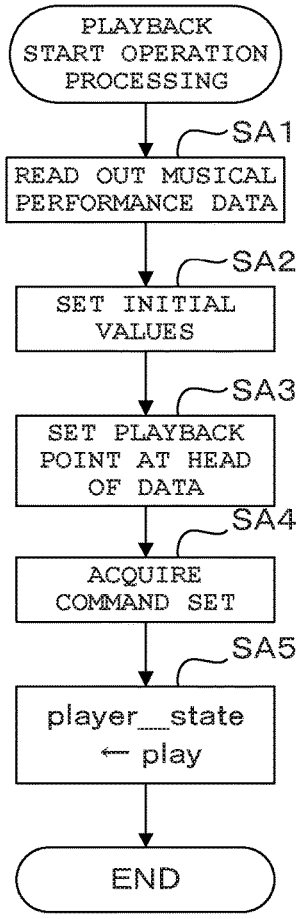
FIG. 4A to FIG. 4C are flowcharts of operations that are performed by a CPU 13 (Central Processing Unit) in playback start operation processing, enlivenment start operation processing, and tick event processing, respectively.

FIG. 4A is a flowchart of operations that are performed by the CPU 13 in the playback start operation processing. When the user operates the playback start switch of the operation section 11 with the electronic musical instrument 100 being in a power-on-state, the CPU 13 proceeds to Step SA1 shown in FIG. 4A. At Step SA1, the CPU 13 reads out musical performance data PD (N) selected by an operation on the musical piece selection switch from the musical performance data area PDA (refer to FIG. 2A) of the ROM 14, and stores it in the playback data area SDA (refer to FIG. 2B) of the RAM 15.

Next, at Step SA2, the CPU 13 extracts musical piece attributions from the system track of the musical performance data PD (N) stored in the playback data area SDA, and sets them in the work area WA of the RAM 15 as initial values. Subsequently, the CPU 13 proceeds to Step SA3, and sets the playback point of the musical performance data PD (N) at a read-out start address corresponding to the head of the data. Then, at Step SA4, the CPU 13 acquires a command set. At Step SA5, the CPU 13 sets the flag "player_state" to "PLAY", and then ends the processing.

(2) Operations in Enlivenment Start Operation Processing

Figure 4B:
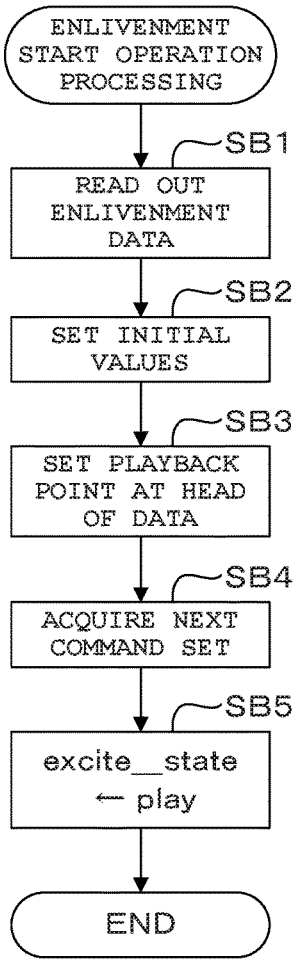

FIG. 4B is a flowchart of operations that are performed by the CPU 13 in the enlivenment start operation processing. When the user operates the enlivenment start switch of the operation section 11 with the electronic musical instrument 100 being in a power-on state, the CPU 13 proceeds to Step SB1 shown in FIG. 4B. At Step SB1, the CPU 13 reads out enlivenment data MD (N) selected by an enlivenment selection operation from the enlivenment data area MDA (refer to FIG. 2A) of the ROM 14, and stores it in the playback data area SDA (refer to FIG. 2B) of the RAM 15.

Next, at Step SB2, the CPU 13 acquires a first command set from the enlivenment data MD (N) stored in the playback data area SDA as initial values. Subsequently, the CPU 13 proceeds to Step SB3, and sets the playback point of the enlivenment data MD (N) at a read-out start address corresponding to the head of the data. Then, at Step SB4, the CPU 13 acquires the next command set. At Step SB5, the CPU 13 sets the flag "excite_state" to "PLAY", and then ends the processing.

(3) Operations in Tick Event Processing

Figure 4C:
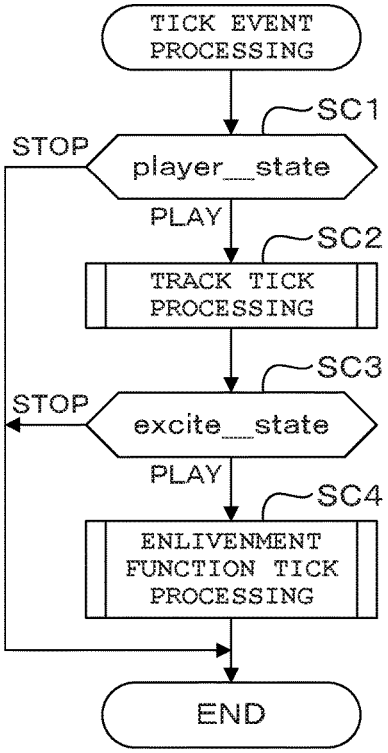

FIG. 4C is a flowchart of operations that are performed by the CPU 13 in the tick event processing. This processing is performed by interrupting every tick (minimum unit time) by a timer interrupt. Note that this "tick" (minimum unit time) is time calculated by 60/BPM (tempo)/time base (resolution).

When the execution timing of this processing comes, the CPU 13 proceeds to Step SC1 shown in FIG. 4C. At Step SC1, the CPU 13 judges whether the flag "player_state" indicates "PLAY", that is, whether the playback of musical performance data PD (N) has been started. When the flag "player_state" indicates "STOP", that is, when the playback of musical performance data PD (N) has been stopped, the CPU 13 ends the processing. When the playback of musical performance data PD (N) has been started and therefore the flag "player_state" indicates "PLAY", the CPU 13 proceeds to the next Step SC2 and performs the track tick processing described later.

Next, the CPU 13 proceeds to Step SC3, and judges whether the flag "excite_state" indicates "PLAY", that is, whether the playback of enlivenment data MD (N) has been started. When the flag "excite_state" indicates "STOP", that is, when the playback of enlivenment data MD (N) has been stopped, the CPU 13 ends the processing. When the playback of enlivenment data MD (N) has been started and therefore the flag "excite_state" indicates "PLAY", the CPU 13 proceeds to the next Step SC4 and performs the enlivenment function tick processing described later.

(4) Operations in Track Tick Processing

Figure 5A:
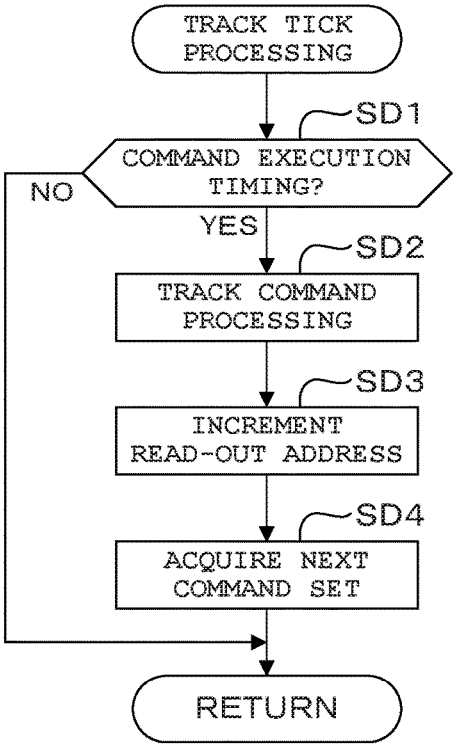
FIG. 5A to FIG. 5B are flowcharts of operations that are performed by the CPU 13 in track tick processing and enlivenment function tick processing.

FIG. 5A is a flowchart of operations that are performed by the CPU 13 in the track tick processing. When this processing is started via Step SC2 of the tick event processing (refer to FIG. 4C) described above, the CPU 13 proceeds to Step SD1 shown in FIG. 5A, and judges whether command execution timing has come. When command execution timing has not come, the judgment result is "NO" and therefore the CPU 13 proceeds to Step SD5 described later.

When command execution timing has come, the judgment result at Step SD1 is "YES" and therefore the CPU 13 proceeds to Step SD2. At Step SD2, the CPU 13 performs the track command processing for replaying the musical performance data PD (N) of a musical performance track currently serving as a processing target. That is, in the track command processing, the CPU 13 instructs the sound source section 16 to generate a musical sound specified by "command" and "value" included in a command set in the musical performance data PD (N).

Next, at Step SD3, the CPU 13 increments the read-out address of the musical performance data PD (N). Then, at Step SD4, the CPU 13 acquires a next command set read out in accordance with the incremented read-out address.

(5) Operations in Enlivenment Function Tick Processing

Figure 5B:
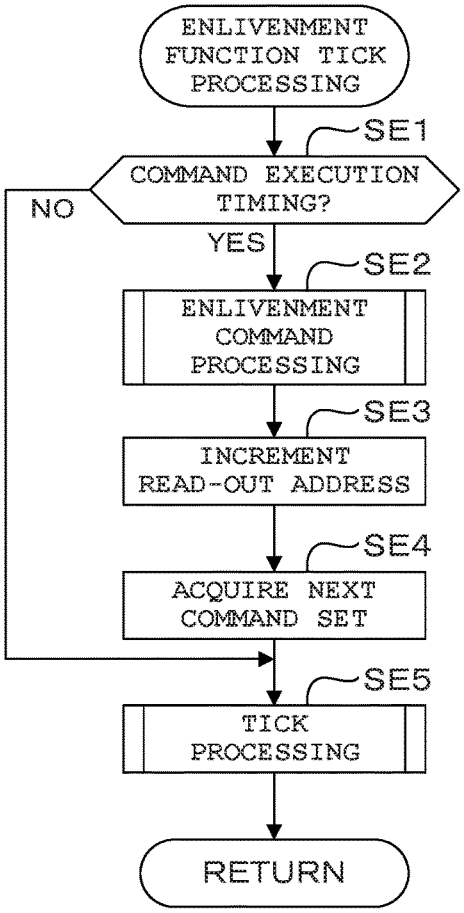

FIG. 5B is a flowchart of operations that are performed by the CPU 13 in the enlivenment function tick processing. When this processing is started via Step SC4 of the tick event processing (refer to FIG. 4C) described above, the CPU 13 proceeds to Step SE1 shown in FIG. 5B, and judges whether command execution timing has come. When command execution timing has not come, the judgment result is "NO" and therefore the CPU 13 proceeds to Step SE5 described later.

When command execution timing has come, the judgment result at Step SE1 is "YES" and therefore the CPU 13 proceeds to Step SE2 to perform the enlivenment command processing. In the enlivenment command processing, the CPU 13 acquires a difference value "diff" and a segment "seg" from a command set in enlivenment data MD (N) associated with the musical performance track currently serving as a processing target, and sets "1 (positive)" or "0 (negative)" for the flag "sign_flag" based on whether the acquired difference value "diff" is a positive value or a negative value, as described later. Subsequently, the CPU 13 performs integer division of the segment "seg" converted to the number of ticks by the difference value "diff", and thereby acquires the number of ticks "ticknum" required per difference value representing "1". Then, CPU 13 resets the counter "ctr" for counting the number of ticks to zero.

Next, at Step SE3, the CPU 13 increments the read-out address of the enlivenment data MD(N). Subsequently, at Step SE4, the CPU 13 acquires a next command set read out in accordance with the incremented read-out address. Then, the CPU 13 performs the tick processing via Step SE5.

In this tick processing, when the difference value "diff" is larger than "0" and the value of the counter "ctr" reaches the number of ticks "ticknum", the CPU 13 decrements (subtraction) the value of a control target specified by "command" in the command set currently serving as a processing target and decrements (subtraction) and updates the difference value "diff" if the difference value "diff" before being an absolute value is a "negative" value, as described later. Here, if the difference value "diff" is a "positive" value, the CPU 13 increments (addition) the value of the control target specified by "command" in the command set currently serving as a processing target, and decrements (subtraction) and updates the difference value "diff". Then, the CPU 13 ends the processing.

(6) Operations in Enlivenment Command Processing

Figure 6:
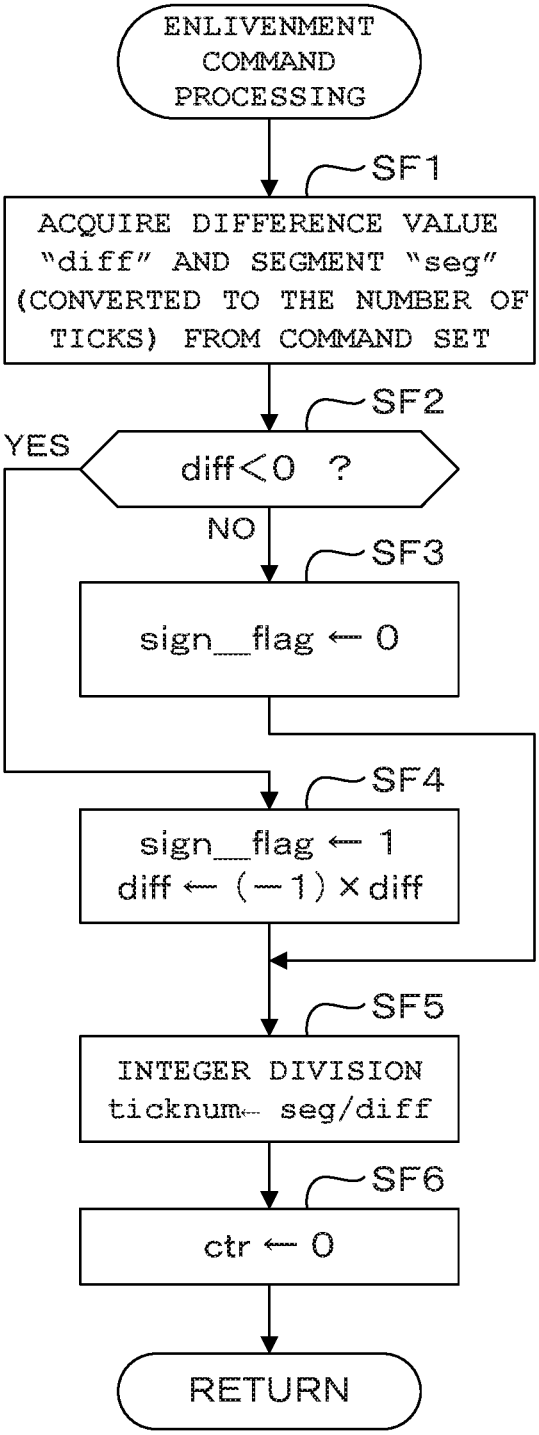
FIG. 6 is a flowchart of operations that are performed by the CPU 13 in enlivenment command processing.

FIG. 6 is a flowchart of operations that are performed by the CPU 13 in the enlivenment command processing. When this processing is started via Step SE2 of the enlivenment function tick processing (refer to FIG. 5B) described above, the CPU 13 proceeds to Step SF1 shown in FIG. 6, and acquires the difference value "diff" and the segment "seg" from the command set currently serving as a processing target.

For example, in a case where "command" in the command set currently serving as a processing target indicates a pitch bend, when the difference value "diff" is "63" and the value of the segment "seg" is "four beats", the segment "seg" converted to the number of ticks is "384" (four beats×96) if the time base (resolution) of the musical performance data PD (N) is "96".

Next, at Step SF2, the CPU 13 judges whether the difference value "diff" is less than "0". When the difference value "diff" is equal to or more than "0", the judgment result is "NO" and therefore the CPU 13 proceeds to Step SF3. At Step SF3, the CPU 13 sets the flag "sign_flag" at "0" so as to indicate that the difference value "diff" is a positive value. When the difference value "diff" is less than "0", the judgment result at Step SF2 is "YES" and therefore the CPU 13 proceeds to Step SF4. At Step SF4, the CPU 13 sets the flag "sign_flag" at "1" so as to indicate that the difference value "diff" is a negative value, and multiplies the difference value "diff" by "−1" to make it an absolute value.

At Step SF5, the CPU 13 performs integer division of the segment "seg" (converted to the number of ticks) by the difference value "diff", and thereby acquires the number of ticks "ticknum" required per difference value representing "1". In the case of the above-described example, the number of ticks "ticknum" is "6" by the calculation of (four beats×96)/63, which indicates that the difference value "diff" is increased by 1 for each 6 ticks. Then, the CPU 13 proceeds to Step SF6 to reset the counter "ctr" for counting the number of ticks to zero, and ends the processing.

As described above, in the enlivenment command processing, the CPU 13 acquires a difference value "diff" and a segment "seg" from a command set currently serving as a processing target, and sets "1 (positive)" or "0 (negative)" for the flag "sign_flag" based on whether the acquired difference value "diff" is a positive value or a negative value.

Subsequently, the CPU 13 performs integer division of the segment "seg" converted to the number of ticks by the difference value "diff", and thereby acquires the number of ticks "ticknum" required per difference value representing "1". Then, CPU 13 resets the counter "ctr" for counting the number of ticks to zero.

(7) Operations in Tick Processing

Figure 7:
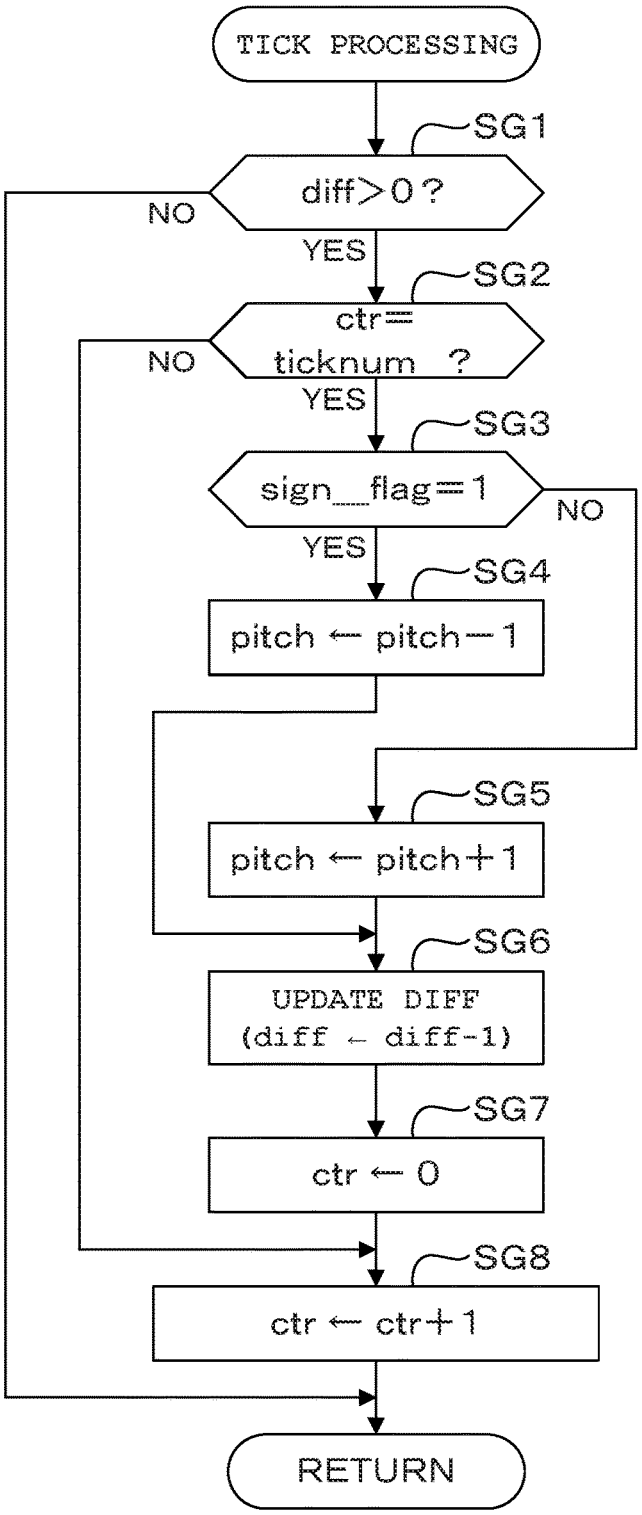
FIG. 7 is a flowchart of operations that are performed by the CPU 13 in tick processing.

FIG. 7 is a flowchart of operations that are performed by the CPU 13 in the tick processing. When this processing is started via Step SE5 of the enlivenment function tick processing (refer to FIG. 5B) described above, the CPU 13 proceeds to Step SG1 shown in FIG. 7, and judges whether the difference value "diff" is larger than "0". When the difference value "diff" is equal to or less than "0", the judgment result is "NO" and therefore the CPU 13 ends the processing. When the difference value "diff" is larger than "0", the judgment result is "YES" and therefore the CPU 13 proceeds to Step SG2.

At Step SG2, the CPU 13 judges whether the value of the counter "ctr" for calculating the number of ticks has reached the number of ticks "ticknum" calculated in the above-described command processing (refer to FIG. 6). When the value of the counter "ctr" has not reached the number of ticks "ticknum", the judgment result is "NO" and therefore the CPU 13 proceeds to Step SG8. At Step SG8, the CPU 13 increments the value of the counter "ctr", and then ends the processing.

Conversely, when the value of the counter "ctr" has reached the number of ticks "ticknum", the judgment result at Step SG2 is "YES" and therefore the CPU 13 proceeds to Step SG3. At Step SG3, the CPU 13 judges whether the flag "sign_flag" is "1", that is, the difference value "diff" is a negative value. When the difference value "diff" is a negative value, the judgment result is "YES" and therefore the CPU 13 proceeds to Step SG4.

At Step SG4, for example, a case where the control target specified by "command" in the command set currently serving as a processing target is "pitch bend", the CPU 13 decrements ("−1" subtraction) the current pitch bend value.

On the other hand, when the flag "sign_flag" is "0", that is, the difference value "diff" is a positive value, the judgment result at Step SG3 is "NO" and therefore the CPU 13 proceeds to Step SG5. At Step SG5, for example, in a case where the control target specified by "command" in the command set currently serving as a processing target is "pitch bend", the CPU 13 increments ("+1" addition) the current pitch bend value. Note that, when the current pitch bend sensitivity value is "2" and the pitch bend value range is "0 to 127", "+2" (two semitones higher) when the pitch bend value is "127", "0" (center) when the pitch bend value is "64", and "−2" (two semitones lower) when the pitch bend value is "0".

After the value of the counter "ctr" reaches the number of ticks "ticknum" and the value of the control target specified by "command" in the command set currently serving as a processing target is incremented (addition) or decremented (subtraction), the CPU 13 proceeds to Step SG6, and decrements and updates (subtraction) the difference value "diff". Subsequently, the CPU 13 proceeds to Step SG7. At Step SG7, the CPU 13 resets the counter "ctr" to zero once and, at Step SG8, increments the counter "ctr" for next tick processing. Then, the CPU 13 ends the processing.

As described above, in the tick processing, when a difference value "diff" is larger than "0" and the value of the counter "ctr" reaches the number of ticks "ticknum", the CPU 13 decrements (subtraction) the value of a control target specified by "command" in a command set currently serving as a processing target and decrements (subtraction) and updates the difference value "diff" if the difference value "diff" before being an absolute value is a "negative" value. If the difference value "diff" is a "positive" value, the CPU 13 increments (addition) the value of the control target specified by "command" in the command set currently serving as a processing target, and decrements (subtraction) and updates the difference value "diff".

As described above, in the first embodiment, enlivenment data MD (N) constituted by command sets each including a segment "seg" and a difference value "diff" is used, and the CPU 13 sets the flag "sign_flag" at "1 (positive)" or "0 (negative)" based on whether a difference value "diff" acquired from a command set currently serving as a processing target is a positive value or a negative value, and acquires the number of ticks "ticknum" required per difference value representing "1" by performing integer division of a segment "seg" converted to the number of ticks by the difference value "diff".

Then, when the difference value "diff" is larger than "0" and the value of the counter "ctr" reaches the number of ticks "ticknum", the CPU 13 decrements (subtraction) the value of a control target specified by "command" in the command set currently serving as a processing target and decrements (subtraction) and updates the difference value "diff" if the difference value "diff" before being an absolute value is a "negative" value. If the difference value "diff" is a "positive" value, the CPU 13 increments (addition) the value of the control target specified by "command" in the command set currently serving as a processing target, and decrements (subtraction) and updates the difference value "diff". As a result of this configuration, musical performance sounds for a musical performance can be sequentially and finely arranged with a decreased volume of musical performance data.

Also, in the first embodiment, a configuration may be adopted in which musical performance data PD, which indicates the pitch and sound emission timing of each note forming a corresponding musical performance part (musical instrument part) of a musical piece and by which a control target such as a pitch or a sound volume is changed, is constituted by command sets each including a segment "seg" and a difference value "diff" for representing sequential changes as in the case of enlivenment data MD (N) By this configuration as well, musical performance sounds for a musical performance can be sequentially and finely arranged with a decreased volume of musical performance data.

C. Second Embodiment

Next, operations in command processing and tick processing according to a second embodiment are described. In the above-described first embodiment a difference value per tick is ±1, and therefore changes at a rate more than this cannot be supported. However, in the second embodiment, command processing and tick processing supporting changes at a rate more than ±1 "difference value/tick" are performed. Operations therein are described with reference to at FIG. 8 and FIG. 9

(1) Operations in Enlivenment Command Processing According to Second Embodiment

Figure 8:
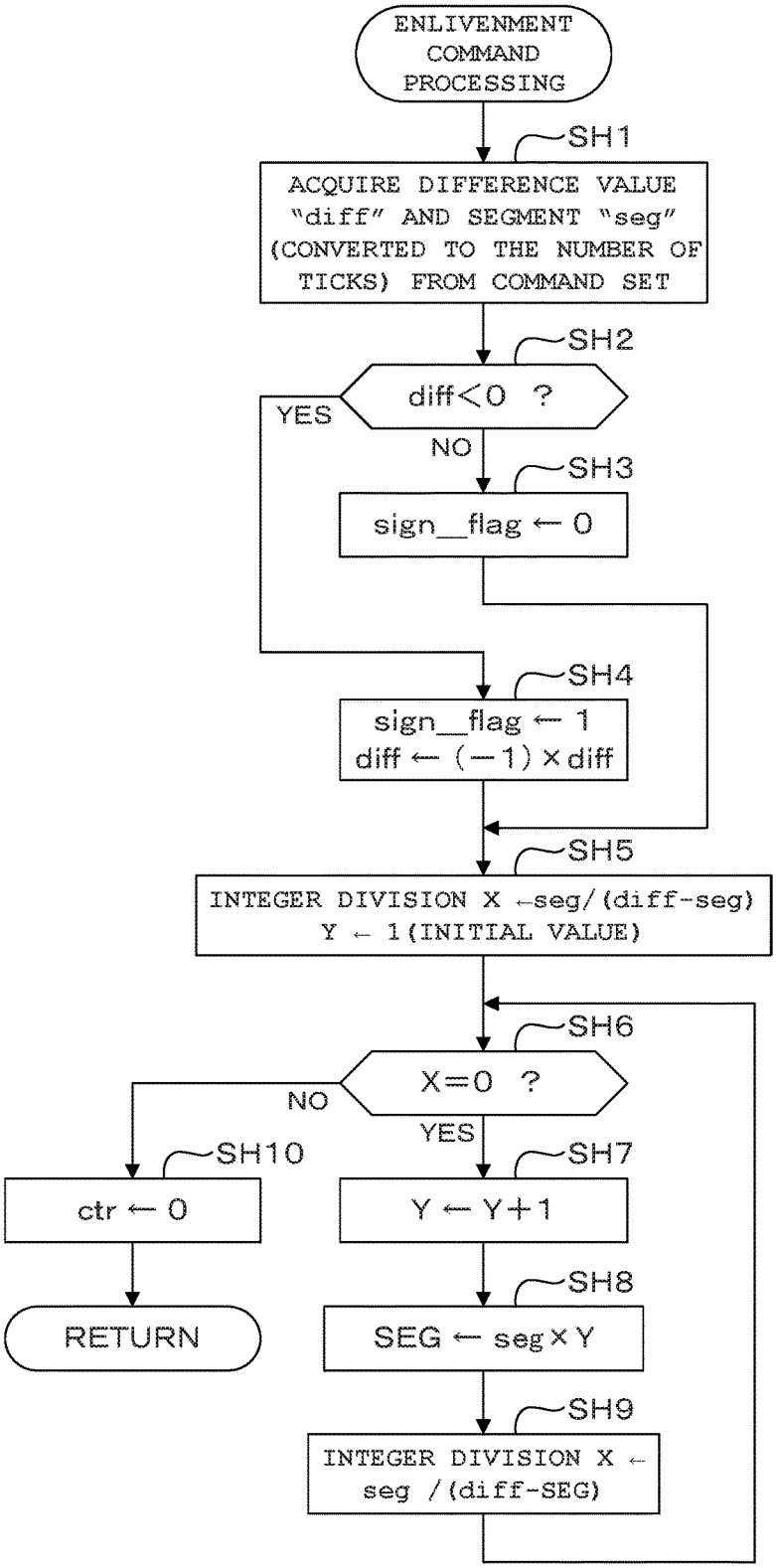
FIG. 8 is a flowchart of operations that are performed by the CPU 13 in enlivenment command processing according to a second embodiment.

FIG. 8 is a flowchart of operations that are performed by the CPU 13 in the enlivenment command processing according to the second embodiment. As in the case of the first embodiment, when this processing is started via Step SE2 of the enlivenment function tick processing (refer to FIG. 5B), the CPU 13 proceeds to Step SH1 shown in FIG. 8, and acquires the difference value "diff" and the segment "seg" from the command set currently serving as a processing target.

For example, in a case where "command" in the command set currently serving as a processing target indicates a pitch bend, when the difference value "diff" is "120" and the value of the segment "seg" is "one beat", the segment "seg" converted to the number of ticks is "48" (one beat×48) if the time base (resolution) of the musical performance data PD (N) is "48".

Next, at Step SH2, the CPU 13 judges whether the difference value "diff" is less than "0". When the difference value "diff" is equal to or more than "0", the judgment result is "NO" and therefore the CPU 13 proceeds to Step SH3. At Step SF3, the CPU 13 sets the flag "sign_flag" at "0" so as to indicate that the difference value "diff" is a positive value. When the difference value "diff" is less than "0", the judgment result at Step SH2 is "YES" and therefore the CPU 13 proceeds to Step SH4. At Step SF4, the CPU 13 sets the flag "sign_flag" at "1" so as to indicate that the difference value "diff" is a negative value, and multiplies the difference value "diff" by "−1" to make it an absolute value.

At Step SH5, the CPU 13 calculates an X value by integer division represented by the following formula (1), and sets a Y value at an initial value of "1". In the case of the above-described example, when the value "48" of the segment "seg" and the value "120" of the difference value "diff" are substituted into the following formula (1), the X value by the integer division is "0".

$$X = \text{segment "seg"}/(\text{difference value "diff"} - \text{segment "seg"}) \quad (1)$$

Next, at Step SH6, the CPU 13 judges whether the X value calculated by the above-described formula (1) is "0". When the X value is "0", the judgment result is "YES" and therefore the CPU 13 proceeds to the next Step SH7. At Step SH7, the CPU 13 increments the Y value (Y+1). Then, at Step SH8, the CPU 13 multiplies the value of the segment "seg" by the incremented value (Y+1) and thereby acquires a SEG value which is (Y+1)-fold of the segment "seg". In the case of the above-described example, the SEG value is "96" by 48×2.

Then, at Step SH9, the CPU 13 calculates an X value by integer division represented by the following formula (2). In the case of the above-described example, when the value "48" of the segment "seg", the value "120" of the difference value "diff", and the SEG value "96" are substituted into the following formula (2), the X value by the integer division is "2".

$$X = \text{segment "seg"}/(\text{difference value "diff"} - \text{"SEG" value}) \quad (2)$$

As such, at Step SH6 to Step SH9 in the case of the above-described example, the X value is "2" when the Y value is "2". That is, when the X value is other than "2", the Y value to be added (or subtracted) is set at "2". when the X value is "2", the value to be added (or subtracted) is set at "3".

As a result, in the tick processing according to the second embodiment described below, when the value of the counter "ctr" is other than "2", the value to be added (or subtracted) is "2". When the value of the counter "ctr" is "2", the value to be added (or subtracted) is "3". Then, when the X value calculated by the above-described formula (2) is other than "0", the judgment result at Step SH6 described above is "NO" and therefore the CPU 13 proceeds to Step SH10. At Step SH10, the CPU 13 resets the counter "ctr" for counting the number of ticks to zero and ends the processing.

(2) Operations in Tick Processing According to Second Embodiment

Figure 9:
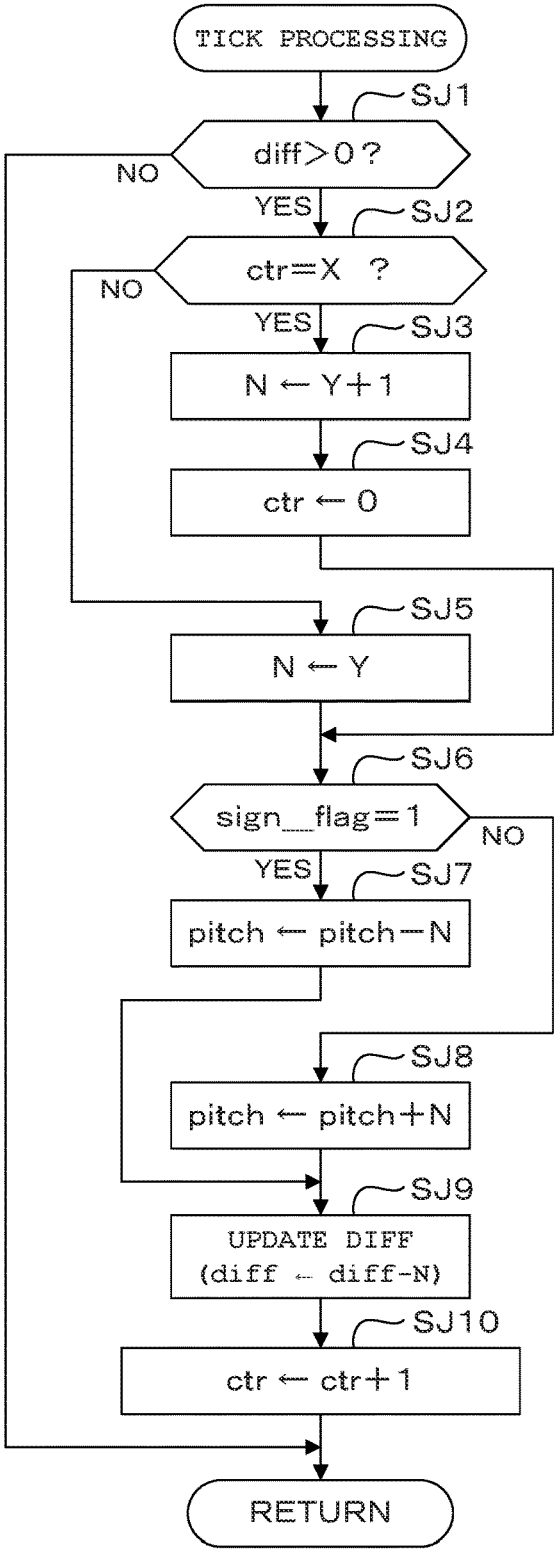
FIG. 9 is a flowchart of operations that are performed by the CPU 13 in tick processing according to the second embodiment.

FIG. 9 is a flowchart of operations that are performed by the CPU 13 in the tick processing according to the second embodiment. As in the case of the first embodiment when this processing is started via Step SE5 of the enlivenment function tick processing (refer to FIG. 5B), the CPU 13 proceeds to Step SJ1 shown in FIG. 9, and judges whether the difference value "diff" is larger than "0". When the difference value "diff" is equal to or less than "0", the judgment result is "NO" and therefore the CPU 13 ends the processing. When the difference value "diff" is larger than "0", the judgment result is "YES" and therefore the CPU 13 proceeds to Step SJ2.

At Step SJ2, the CPU 13 judges whether the value of the counter "ctr" for calculating the number of ticks coincides with the X value calculated in the above-described command processing (refer to FIG. 8). When the value of the counter "ctr" does not coincide with the X value, the judgment result is "NO" and therefore the CPU 13 proceeds to Step SJ5. At Step SJ5, the CPU 13 sets the Y value calculated in the above-described command processing (refer to FIG. 8) as a change amount N and then proceeds to Step SJ6.

Conversely, when the value of the counter "ctr" coincides with the X value, the judgment result at Step SJ2 is "YES" and therefore the CPU 13 proceeds to Step SJ3. At Step SJ3, the CPU 13 sets the (Y+1) value calculated in the above-described command processing (refer to FIG. 8) as a change amount N and then proceeds to Step SJ6.

At Step SG6, the CPU 13 judges whether the flag "sign_flag" is "1", that is, the difference value "diff" is a negative value. When the difference value "diff" is a negative value, the judgment result is "YES" and therefore the CPU 13 proceeds to Step SJ7. At Step SJ7, for example, in a case where the control target specified by "command" in the command set currently serving as a processing target is "pitch bend", the CPU 13 subtracts the change amount N from the current pitch bend value and then proceeds to Step SJ9.

On the other hand, when the flag "sign_flag" is "0", that is, the difference value "diff" is a positive value, the judgment result at Step SJ6 is "NO" and therefore the CPU 13 proceeds to Step SJ8. At Step SJ8, for example, in a case where the control target specified by "command" in the command set currently serving as a processing target is "pitch bend", the CPU 13 adds the change amount N to the current pitch bend value and then proceeds to Step SJ9. At Step SJ9, the CPU 13 subtracts the change amount N from the difference value "diff" and thereby updates the difference value "diff". Then, the CPU 13 proceeds to Step SJ10, increments the counter "ctr" for the next tick processing, and ends the processing.

As such, in the second embodiment, for example, when a Y value is determined to be "2" and a X value is determined to be "2" as described above based on a difference value "diff" and a segment "seg" included in a command set currently serving as a processing target, a change amount N to be increased (or decreased) is set to be "2" (Y) if the value of the counter "ctr" for counting the number of ticks is other than "2". If the value of the counter "ctr" is "2", the change amount N to be increased (or decreased) is set at "3" (Y+1).

Then, for example, in a case where a control target specified by "command" in the command set currently serving as a processing target is "pitch bend", the change amount N in accordance with the value of the counter "ctr" is added to (or subtracted from) the current pitch bend value, and the difference value "diff" is updated in accordance with the added (subtracted) change amount N. As a result of this configuration, changes at a rate more than ±1 "difference value/tick" can be supported and musical performance sounds for a musical performance can be sequentially and finely arranged with a decreased volume of musical performance data.

Note that, although the above-described embodiments have been configured such that the CPU (general-purpose processor) executes the programs stored in the ROM (memory) and thereby actualizes a control section which performs various control operations, a configuration may be adopted in which these plurality of control operations are assigned to dedicated processors, respectively. In this configuration, each dedicated processor may be constituted by a general-purpose processor (electronic circuit) capable of executing an arbitrary program and a memory having stored therein a control program dedicated to one of the control operations, or may be constituted by an electronic circuit dedicated to one of the control operations.

Also, apparatuses for achieving the above-described various effects are not necessarily required to have the above-described configuration and may have, for example, configurations described below.

Configuration Example 1

A musical sound playback apparatus including: a sound source section (sound source circuit) which generates musical sounds while sequentially changing the musical sounds to be in instructed states in response to reception of instruction data for providing instructions regarding musical sound states to be achieved; an interpolation section which, by using data in a memory, generates a plurality of interpolated data where input data (command set) for a segment corresponding to the musical sounds has been interpolated, based on values in the input data which are related to both the segment corresponding to the musical sounds and a change amount of the musical sounds to be replayed for the segment; and a playback control section which generates a plurality of instruction data (MIDI (Musical instrument Digital Interface) data) for providing instructions regarding musical sound states to be achieved at a plurality of timings in the segment, based on the plurality of interpolated data, and sequentially transmits the plurality of generated instruction data to the sound source section when a musical sound playback for the segment is performed.

Configuration Example 2

The musical sound playback apparatus of configuration example 1, in which the memory stores enlivenment data specifying a control target related to musical sound generation, a segment where a set value of the control target is changed, and a change amount of the set value of the control target and in which the playback control section (1) reads out, as the input data, the enlivenment data stored in the memory, (ii) generates a plurality of instruction data for changing, in the segment, the set value of the control target by the change amount in a stepwise manner in accordance with the read enlivenment data, and (iii) sequentially transmits the plurality of generated instruction data to the sound source section when a musical sound playback for the segment is performed.

Configuration Example 3

The musical sound playback apparatus of configuration example 2, in which the memory further stores musical performance data specifying control targets related to musical sound generation, set values of the control targets, and timings at which the set values are set for the control targets, and in which the playback control section (i) reads out, as the input data, the musical performance data stored in the memory, and (ii) sequentially provides instructions regarding musical sound states to be achieved to the sound source section at the respective timings with musical sound states where the respective set values have been set for the respective control targets as the musical sound states to be achieved, in accordance with the read musical performance data.

Configuration Example 4

The musical sound playback apparatus of configuration example 3, further including: a setting section which sets whether or not to use the musical performance data or the enlivenment data stored in the memory for a musical sound playback by the playback control section.

Configuration Example 5

The musical sound playback apparatus of configuration example 2 in which the control target includes one of a pitch, a modulation, and a sound volume.

Configuration Example 6

The musical sound playback apparatus of configuration example 1, in which the interpolation is to interpolate the input data such that at least one of a pitch, a modulation, and a sound volume of the musical sounds is changed in the segment, based on an identifier which is included in the input data in a command set format and indicates one of the pitch, the modulation, and the sound volume.

Configuration Example 7

The musical sound playback apparatus of configuration example 1, in which the sound source section has set therein a minimum unit time and a minimum change amount by which states of the musical sounds to be generated can be changed at once, in which the playback control section, when number of times the states of the musical sounds to be generated can be changed in the segment is larger than number of times required for the change amount to be changed in a stepwise manner under limitation of the minimum unit time and the minimum change amount, generates the plurality of instruction data based on a change method in which the states of the musical sounds to be generated are changed by the minimum change amount for each minimum unit time or changed by the minimum change amount for each set of minimum unit times, and in which the playback control section, when the number of times the states of the musical sounds to be generated can be changed in the segment is less than the number of times required for the change amount to be changed in the stepwise manner under the limitation of the minimum unit time and the minimum change amount, generates the plurality of instruction data based on a change method in which the states of the musical sounds to be generated are changed by the minimum change amount for each minimum unit time or changed by an amount equal to a plurality of minimum change amounts for each minimum unit time.

Configuration Example 8

The musical sound playback apparatus of configuration example 1, further including: a calculation section which calculates, when resolution of the segment is larger than the change amount, a temporal resolution required for an integral value of the change amount to be changed, in which the playback control section interpolates the input data such that the musical sounds are changed by an amount equal to the integral value for each amount of time corresponding to the temporal resolution, and replays the musical sounds.

Configuration Example 9

The musical sound playback apparatus of configuration example 1, further including: an x calculation section which, when resolution of the segment is less than the change amount and x, which is a temporal resolution calculated with 1 as an initial value of an integral value y in formula (1) and is an integral value acquired by rounding down decimal places, is 0, repeatedly calculates x by incrementing y by 1 until when x is equal to more than 1, in which x=resolution of segment/(change amount−y×resolution of segment) . . . (1), and in which the playback control section interpolates the input data by incrementing the integral value y by 1 for each temporal resolution x calculated by the x calculation section and by not incrementing the integral value y for temporal resolutions other than the temporal resolution x, and replays the musical sounds.

Configuration Example 10

The musical sound playback apparatus of configuration example 3, in which the memory stores musical performance data and enlivenment data corresponding to each of a plurality of tracks, and in which the playback control section replays musical sounds of the plurality of tracks simultaneously in parallel based on the musical performance data and the enlivenment data stored corresponding to each track.

Configuration Example 11

An electronic musical instrument including: the musical sound playback apparatus of anyone of configuration examples 1 to 10, and a musical performance control section which (i) sequentially generates instruction data for providing instructions regarding musical sound states to be achieved, in response to musical performance input operations, and (ii) sequentially provides the instructions regarding the musical sound states to be achieved to the sound source section, in accordance with the sequentially generated instruction data.

Configuration Example 12

The electronic musical instrument of configuration example 11, further including: a keyboard having a plurality of keys, in which the musical performance input operations are musical performance operations performed by the keyboard.

While the present invention has been described with reference to the preferred embodiments, it is intended that the invention be not limited by any of the details of the description therein but includes all the embodiments which fall within the scope of the appended claims.

What is claimed is:

1. A musical sound playback method that is performed by a processor using data in a memory, comprising:

generating a plurality of interpolated data where input data for a segment corresponding to musical sounds has been interpolated, based on values in the input data which are related to both the segment corresponding to the musical sounds and a change amount of the musical sounds to be replayed for the segment;

generating a plurality of instruction data for providing instructions regarding musical sound states to be achieved at a plurality of timings in the segment, based on the plurality of interpolated data; and sequentially transmitting the plurality of generated instruction data to a sound source circuit so as to cause the sound source circuit to generate the musical sounds while sequentially changing the musical sounds to be in the musical sound states instructed by the instruction data, when a musical sound playback for the segment is performed.

2. The musical sound playback method according to claim 1, wherein the processor (i) reads out, as the input data, enlivenment data specifying a control target related to musical sound generation, a segment where a set value of the control target is changed, and a change amount of the set value of the control target from the memory having stored therein the enlivenment data, (ii) generates a plurality of instruction data for changing, in the segment, the set value of the control target by the change amount in a stepwise manner in accordance with the read enlivenment data, and (iii) sequentially transmits the plurality of generated instruction data to the sound source circuit when a musical sound playback for the segment is performed.

3. The musical sound playback method according to claim 2, wherein the memory further stores musical performance data specifying control targets related to musical sound generation, set values of the control targets, and timings at which the set values are set for the control targets, and wherein the processor (i) reads out, as the input data, the musical performance data stored in the memory, and (ii) sequentially provides instructions regarding musical sound states to be achieved to the sound source circuit at the respective timings with musical sound states where the respective set values have been set for the respective control targets as the musical sound states to be achieved, in accordance with the read musical performance data.

4. The musical sound playback method according to claim 3, wherein the processor sets whether or not to use the musical performance data or the enlivenment data stored in the memory for a musical sound playback.

5. The musical sound playback method according to claim 2, wherein the control target includes one of a pitch, a modulation, and a sound volume.

6. The musical sound playback method according to claim 1, wherein the interpolation is to interpolate the input data such that at least one of a pitch, a modulation, and a sound volume of the musical sounds is changed in the segment, based on an identifier which is included in the input data in a command set format and indicates one of the pitch, the modulation, and the sound volume.

7. The musical sound playback method according to claim 1, wherein the sound source circuit has set therein a minimum unit time and a minimum change amount by which states of the musical sounds to be generated can be changed at once, wherein the processor, when number of times the states of the musical sounds to be generated can be changed in the segment is larger than number of times required for the change amount to be changed in a stepwise manner under limitation of the minimum unit time and the minimum change amount, generates the plurality of instruction data based on a change method in which the states of the musical sounds to be generated are changed by the minimum change amount for each minimum unit time or changed by the minimum change amount for each set of minimum unit times, and wherein the processor, when the number of times the states of the musical sounds to be generated can be changed in the segment is less than the number of times required for the change amount to be changed in the stepwise manner under the limitation of the minimum unit time and the minimum change amount, generates the plurality of instruction data based on a change method in which the states of the musical sounds to be generated are changed by the minimum change amount for each minimum unit time or changed by an amount equal to a plurality of minimum change amounts for each minimum unit time.

8. The musical sound playback method according to claim 1, wherein the processor calculates, when a resolution of the segment is larger than the change amount, a temporal resolution required for an integral value of the change amount to be changed, and wherein the processor interpolates the input data such that the musical sounds are changed by an amount equal to the integral value for each amount of time corresponding to the temporal resolution, and replays the musical sounds.

9. The musical sound playback method according to claim 1, wherein the processor, when a resolution of the segment is less than the change amount and x, which is a temporal resolution calculated with 1 as an initial value of an integral value y in formula (1) and is an integral value acquired by rounding down decimal places, is 0, repeatedly calculates x by incrementing y by 1 until when x is equal to more than 1, $$\text{wherein } x = \text{resolution of segment}/(\text{change amount} - y \times \text{resolution of segment}) \quad (1), \text{ and}$$

wherein the processor interpolates the input data by incrementing the integral value y by 1 for each temporal resolution x calculated by the x calculation section and by not incrementing the integral value y for temporal resolutions other than the temporal resolution x, and replays the musical sounds.

10. The musical sound playback method according to claim 3, wherein the memory stores musical performance data and enlivenment data corresponding to each of a plurality of tracks, and wherein the processor replays musical sounds of the plurality of tracks simultaneously in parallel based on the musical performance data and the enlivenment data stored corresponding to each track.

11. A musical sound playback apparatus comprising:

a sound source circuit which generates musical sounds while sequentially changing the musical sounds to be in instructed states in response to reception of instruction data for providing instructions regarding musical sound states to be achieved; and a processor which, by using data in a memory, (i) generates a plurality of interpolated data where input data for a segment corresponding to the musical sounds has been interpolated, based on values in the input data which are related to both the segment corresponding to the musical sounds and a change amount of the musical sounds to be replayed for the segment, (ii) generates a plurality of instruction data for providing instructions regarding musical sound states to be achieved at a plurality of timings in the segment, based on the plurality of interpolated data, and (iii) sequentially transmits the plurality of generated instruction data to the sound source circuit when a musical sound playback for the segment is performed.

12. The musical sound playback apparatus according to claim 11, wherein the memory stores enlivenment data specifying a control target related to musical sound generation, a segment where a set value of the control target is changed, and a change amount of the set value of the control target, and wherein the processor (i) reads out, as the input data, the enlivenment data stored in the memory, (ii) generates a plurality of instruction data for changing, in the segment, the set value of the control target by the change amount in a stepwise manner in accordance with the read enlivenment data, and (iii) sequentially transmits the plurality of generated instruction data to the sound source circuit when a musical sound playback for the segment is performed.

13. An electronic musical instrument comprising:

the musical sound playback apparatus according to claim 11, and a musical performance control section which (i) sequentially generates instruction data for providing instructions regarding musical sound states to be achieved, in response to musical performance input operations, and (ii) sequentially provides the instructions regarding the musical sound states to be achieved to the sound source circuit, in accordance with the sequentially generated instruction data.

14. The electronic musical instrument according to claim 13, further comprising:

a keyboard having a plurality of keys, wherein the musical performance input operations are musical performance operations performed by the keyboard.

15. A non-transitory computer-readable storage medium having stored thereon a program that is executable by a computer to actualize functions comprising:

generating a plurality of interpolated data where input data for a segment corresponding to musical sounds has been interpolated, based on values in the input data which are related to both the segment corresponding to the musical sounds and a change amount of the musical sounds to be replayed for the segment;

generating a plurality of instruction data for providing instructions regarding musical sound states to be achieved at a plurality of timings in the segment, based on the plurality of interpolated data; and sequentially transmitting the plurality of generated instruction data to a sound source circuit so as to cause the sound source circuit to generate the musical sounds while sequentially changing the musical sounds to be in the musical sound states instructed by the instruction data, when a musical sound playback for the segment is performed.

16. The non-transitory computer-readable storage medium according to claim 15, wherein the program (i)

reads out, as the input data, enlivenment data specifying a control target related to musical sound generation, a segment where a set value of the control target is changed, and a change amount of the set value of the control target from a memory having stored therein the enlivenment data, (ii) generates a plurality of instruction data for changing, in the segment, the set value of the control target by the change amount in a stepwise manner in accordance with the read enlivenment data, and (iii) sequentially transmits the plurality of generated instruction data to the sound source circuit when a musical sound playback for the segment is performed.

* * * * *